US005669342A

United States Patent [19]

Speil

[11] Patent Number: 5,669,342

[45] Date of Patent: Sep. 23, 1997

[54] DEVICE FOR SIMULTANEOUS ACTUATION OF AT LEAST TWO GAS EXCHANGE VALVES

[75] Inventor: Walter Speil, Ingolstadt, Germany

[73] Assignee: INA Walzlager Schaeffler KG, Germany

[21] Appl. No.: 608,281

[22] Filed: Feb. 28, 1996

Related U.S. Application Data

[63] Continuation of Ser. No. 407,450, Mar. 17, 1995, abandoned.

[30] Foreign Application Priority Data

Apr. 14, 1994 [DE] Germany ..... 9406190 U

[51] Int. Cl.[6] ..... F01L 1/26; F01L 1/18

[52] U.S. Cl. ..... 123/90.16; 123/90.22; 123/198 F

[58] Field of Search ..... 123/90.22, 90.23, 123/90.15, 90.16, 90.48, 90.5, 90.52, 90.55, 198 F

[56] References Cited

U.S. PATENT DOCUMENTS

| | | | |
|---|---|---|---|
| 4,430,969 | 2/1984 | Holtzberg et al. | 123/90.39 |
| 4,790,274 | 12/1988 | Inoue et al. | 123/198 F |
| 5,085,182 | 2/1992 | Nakamura et al. | 123/90.16 |
| 5,090,364 | 2/1992 | McCarroll et al. | 123/90.16 |
| 5,261,361 | 11/1993 | Speil | 123/90.22 |
| 5,345,904 | 9/1994 | Dopson et al. | 123/198 F |

*Primary Examiner*—Weilun Lo

*Attorney, Agent, or Firm*—Bierman & Muserlian

[57] ABSTRACT

A device (1) for simultaneous actuation of at least two gas exchange valves (2) of an internal combustion engine comprising a bridge-type cam follower (3) arranged in driving relationship between a camshaft and the gas exchange valves (2) and serving to directly transmit a stroke motion caused by a control cam (4) of the camshaft to the gas exchange valves (2), said cam follower (3) being guided by guiding means (18,19) for vertical displacement in a cylinder head and comprising a cam contacting element (31) on which the control cam (4) runs, characterized in that the cam contacting element (31) in the cam follower (3) is displaceable relative to the cam follower (3) so that the cam follower (3) can be uncoupled from a stroke-transmitting motion of the control cam (4).

20 Claims, 1 Drawing Sheet

DEVICE FOR SIMULTANEOUS ACTUATION OF AT LEAST TWO GAS EXCHANGE VALVES

PRIOR APPLICATION

Figure 1:
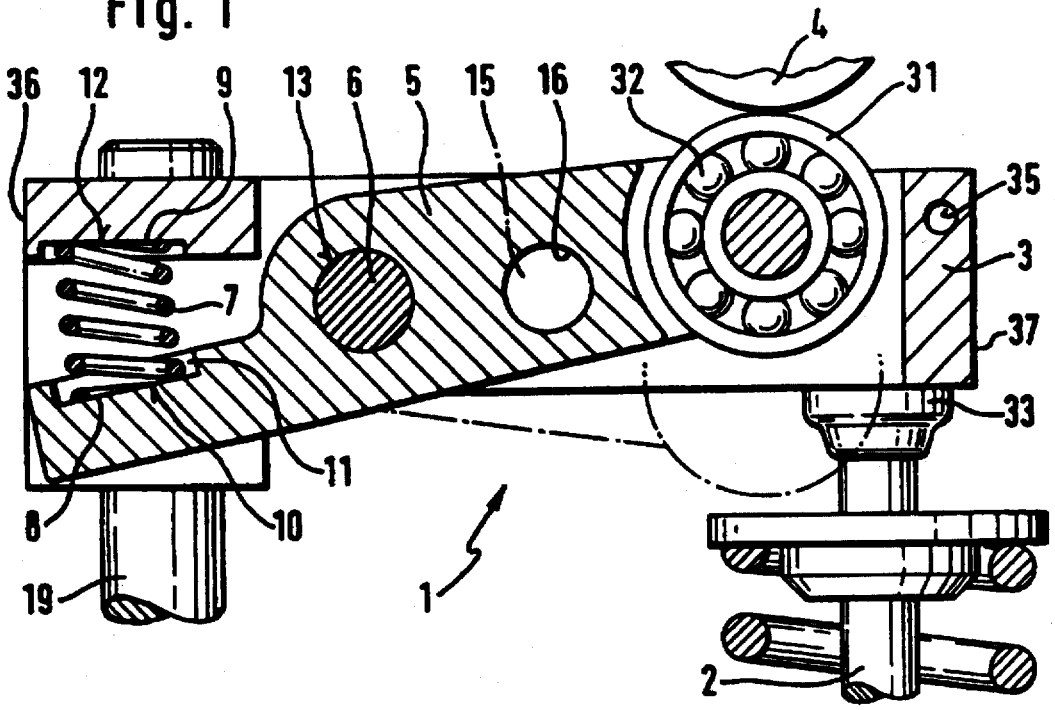

This application is a continuation of U.S. patent application Ser. No. 407,450 filed Mar. 17, 1995, now abandoned.

STATE OF THE ART

A device for the simultaneous actuation of at least two gas exchange valves of an internal combustion engine comprising a bridge-type cam follower arranged in driving relationship between a camshaft and the gas exchange valves and serving to directly transmit a stroke motion caused by a control cam of the camshaft to the gas exchange valves, said cam follower being guided by guiding means for vertical displacement in a cylinder head and comprising a cam contacting element on which the control cam runs is known from DE-A 4,023,886. Likewise, this comprises a bridge-type housing which is contacted by a cam and acts simultaneously on two gas exchange valves. A disadvantage of this known cam follower is that it permanently transmits stroke motions, i.e. even at low rotational speed or under low load. It would be desirable in this operational state of the internal combustion engine, for instance, to put entire cylinders or rows of cylinders (V-type engines) out of action to save fuel and minimize exhaust emission.

Devices for the simultaneous actuation of two gas exchange valves involving a selective modification of the opening stroke are known from the state of the art as illustrated by U.S. Pat. No. 4,905,639, but they all have recourse to differing cam contours. This method disadvantageously necessitates three cams and causes high frictional losses because the transmission of cam travel to the valve is effected via a sliding contact. Further, WO-91/12415 describes a double finger lever system in which a central lever is designed to be switchable relative to the other lever. However, this known configuration as a rule also disadvantageously necessitates three cams and three cam contacting elements.

OBJECTS OF THE INVENTION

It is an object of the invention to provide a device of the type initially cited in which the aforesaid disadvantages are eliminated and which, particularly, has a simple structure for the simultaneous actuation of two or more gas exchange valves and is switchable between at least two different types of valve strokes such as full strokes and zero strokes.

This and other objects and advantages of the invention will become obvious from the following detailed description.

THE INVENTION

The novel device of the invention for simultaneous actuation of at least two gas exchange valves (2) of an internal combustion engine comprising a bridge-type cam follower (3) arranged in driving relationship between a camshaft and the gas exchange valves (2) and serving to directly transmit a stroke motion caused by a control cam (4) of the camshaft to the gas exchange valves (2), said cam follower (3) being guided by guiding means (18,19) for vertical displacement in a cylinder head and comprising a cam contacting element (31) on which the control cam (4) runs, is characterized in that the cam contacting element (31) in the cam follower (3) is displaceable relative to the cam follower (3) so that the cam follower (3) can be at least partially uncoupled from a stroke-transmitting motion of the control cam (4).

This object is achieved by the fact that the cam contacting element in the cam follower is displaceable relative to the cam follower so that the cam follower can be at least partially uncoupled from the stroke-transmitting motion of the control cam. In an embodiment of the invention, the pivotable cam contacting element is formed on a lever mounted in the cam follower, and a displaceable coupling means is provided in the lever, which means comes to extend beyond at least one parting plane formed between the lever and the cam follower to effect coupling, the cam contacting element being brought to bear against the control cam by the lever and by a spring means acting between the lever and the cam follower.

Thus, in the uncoupled state, the lever executes an idle stroke motion relative to the cam follower on its own mounting. During this idle stroke motion, the gas exchange valves remain closed. An ideal timing for the coupling of the lever is during a base circle phase of the actuating control cam. This embodiment of the invention also provides for different "coupling stages" by which it is possible to effect only partial strokes of the gas exchange valves concerned.

Other embodiments include those in which, when the cam follower is uncoupled from the control cam, the lever concerned is retained in the position of its bottom dead center. This can be obtained, for instance, by separate retaining means but also by the already described coupling means. By this "retention", the lever of the cam follower is completely cut-off from the driving motion of the control cam during a desired uncoupled state between the cam follower and the control cam. Thus, additional frictional losses otherwise caused by the idle strokes of the lever and its contact with the control cam are eliminated in a simple manner.

In another embodiment of the invention, the lever is configured as a rocker arm and supported on the cam follower by spring means. However, the lever can also be made as a finger lever or have a fork-shaped geometry. Different combinations of the arrangement of the spring means for the rocker arm or the finger lever, and of its mounting and its cam contacting element are also conceivable. It is also possible to support the spring means at one end on a cylinder head of the internal combustion engine, while its other end acts on the lever for assuring permanent cam contact in the uncoupled state of the lever.

A simple possibility of mounting the lever on the cam follower is to use a pin, but it is likewise possible to use a rolling bearing or a ball-and-socket joint or integral pegs formed on the lever and oriented towards the camshaft are guided in a lodging of the cam follower.

The coupling means of the invention is a pin displaceable by a hydraulic medium. Advantageously, the initial position of the pin is its coupling position, i.e. the pin extends beyond a parting plane situated between the lever and the cam follower. For this, the coupling means is displaced in the coupling direction by the force of a pressure spring, but it is also conceivable that the coupling is effected with the help of a hydraulic medium and uncoupling by the force of a pressure spring or other suitable means. Such means can include other mechanical spring elements such as leaf springs, disc springs and the like, but a suspension in at least one direction is also possible by magnetic, electromagnetic, pneumatic or similar means.

To further minimize friction in the valve drive, the cam contacting element of the invention is a roller mounted in the lever, preferably on a rolling bearing. If, in the coupled state of the cam follower, this roller does not protrude beyond the cam follower, or does so only slightly, the overall height of the entire device is minimized. It is also possible to mount the roller in a cup-shaped lodging of the lever, if necessary on rolling elements arranged therein.

The invention provides a simple means for feeding hydraulic medium to the pin for coupling the lever to the cam follower. Hydraulic medium is transferred via a duct in the cylinder head through a rising bore in one of the guiding columns of the cam follower into a transverse bore of the cam follower and from there to the pin. If it is desired to also re-position the pin by hydraulic means, a similar hydraulic medium feed can be arranged through the other column to the other end face of the pin or coupling means. Guide walls extending vertically from the cylinder head may be used in place of the columns for guiding the cam follower, in which case, oil supply to the coupling means is effected via the guide walls.

Advantageously, hydraulic clearance compensation elements are arranged in the valve-side end of the cam follower. These clearance compensation elements can be supplied at the same time with hydraulic medium via the supply duct from the cylinder head to the coupling means in the cam follower. However, it is also possible to provide a separate supply to the clearance compensation element through the other column. In this case, a deficiency of hydraulic medium is excluded when, in the coupled state, the pressure of the hydraulic medium acting on the pin is at a reduced level.

The bores for the pin in the cam follower and the lever can be made with the same tool in a single work step, and their ends are advantageously sealed in an oil-tight manner by disc-shaped stoppers. However, it is also conceivable to use a rolling element or any other suitable means. The coupling motion of the pin towards the cam follower is limited by a stop in the bore of the cam follower. Due to this stop, it is guaranteed that the hydraulic medium is reliably routed to flow over the end face of the pin.

If at least one of the components is made of a light-weight and/or a plastic material, the oscillating mass of the valve drive is further minimized. It is possible to make the lever or the basic structure of the cam follower of a fiber-reinforced plastic material, but an aluminum alloy or a similar suitable material combination may also be used. Regions possibly subjected to high loading can then be reinforced by suitable lattice or particle intercalations or protected by a wear coating.

REFERRING NOW TO THE DRAWINGS

Figure 2:
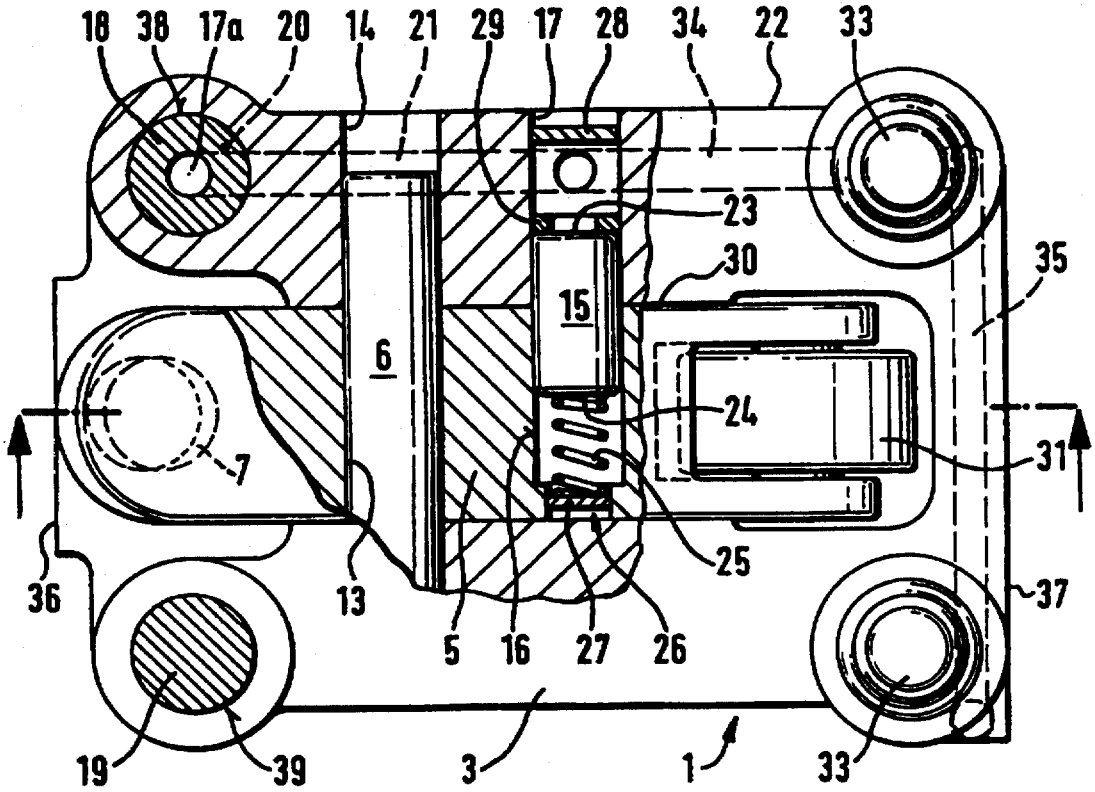

FIG. 1 is a longitudinal cross-section through one embodiment of the invention, and FIG. 2 is a top view of the device in FIG. 1.

FIGS. 1 and 2 show a device (1) for the simultaneous actuation of at least two gas exchange valves (2) comprising a cam follower (3) of a bridge-type configuration positioned in driving relationship between a control cam (4) of a camshaft and the gas exchange valve (2). A pivotable cam contacting element (5) extends in the cam follower (3). In this embodiment, the cam contacting element (5) is made in the form of a rocker arm and connected to the cam follower (3) by a pin (6). The rocker arm (5) is supported at one end on the cam follower (3) by a coil spring (7). One end (8) of the spring (7) acts on an end face (10) of the rocker arm (5) which in this region comprises a recess (11), while the other end (9) of the coil spring (7) acts on a stop face (12) of the cam follower (3). The pin (6) is positioned in a bore (13) of the rocker arm (5) with its ends being arranged in a complementary bore (14) in the cam follower (3).

In the coupled operational state, the cam follower (3) is connected to the rocker arm (5) by an axially displaceable pin (15) which extends in a common bore (16,17) through the rocker arm (5) and the cam follower (3), generally parallel to the camshaft direction. A duct (17*a*) for supply of hydraulic medium to the pin (15) is made in one of the guiding columns (18,19) of the cam follower (3). This duct (17*a*) is fed with hydraulic medium from a supply gallery, not shown, from the cylinder head of the internal combustion engine. In the region of the cam follower (3), the column (18) comprises an orthogonally intersecting bore (20). Hydraulic medium is transferred from the duct (17*a*) through this bore (20) to the duct (21) leading to the bore (17) of the pin (15). The duct (21) extends close to one side wall (22) of the cam follower (3) and generally parallel thereto. The bore (17) which faces a first end face (23) of the pin (15) thus serves as a pressure chamber.

A pressure spring (25) is supported on the other end face (24) of the pin (15). At its other end, this pressure spring (25) acts on the base (26) of the bore (16) in the cam contacting element (5) where it is associated to a disc-shaped stopper (27) which limits the bore (16) in an oil-tight manner towards the outside, while a further stopper (28) on the other side seals the bore (17) in the cam follower (3) radially outwards.

The coupling motion of the pin (15) is limited in a radially outward direction by a stop means (29) in the bore (17). This stop means (29) is arranged, seen radially inwards, behind the duct (21) so that a sufficiently large pressure chamber is formed in the bore (17) for pressure application to the pin (15).

When an uncoupling of the cam follower (3) from the stroke-transmitting motion of the control cam (4) is desired, the pressure of the hydraulic medium acting on the end face (23) of the pin (15) via the duct (17*a*), the bore (20), the duct (21) and the bore (17) is increased so that the pin (15) is displaced against the force of the pressure spring (25) out of its bore (17) completely into the bore (16) of the rocker arm (5). The pin (15) thus no longer extends beyond a parting plane (30) situated between the components (3) and (5) so that the rocker arm (5) executes an idle stroke relative to the cam follower (3) in accordance with the contour of the control cam (4). The cam follower (3) thus remains at rest and the gas exchange valve (2) concerned remains closed. If a coupling is intended, for instance in the operational state of the internal combustion engine mentioned in the discussion of advantages of the invention, the pressure of the hydraulic medium in the duct (17*a*) is reduced so that, in a base circle phase of the control cam (4), the end face (23) of the pin (15) is aligned with the bore (17) of the cam follower (3) and then displaced into the bore (17) with a part of its peripheral surface still remaining in the bore (16). The cam follower (3) is now in driving relationship with the control cam (4) and the gas exchange valve (2) concerned opens with the stroke-transmitting motion of the control cam (4).

As can further be seen in FIG. 1, the rocker arm (5) comprises a direct cam contacting element in the form of a roller (31) which is mounted on a rolling bearing (32) for low friction on the rocker arm (5). In the cam follower (3), there is arranged facing each gas exchange valve (2), a clearance compensation element (33). These clearance compensation elements (33) are supplied with hydraulic medium through a bore (34) extending parallel to the side wall (22) of the cam follower (3), one end of the said bore (34)

communicating with the bore (17) of the cam follower (31). Thus, a common supply of hydraulic medium to the pin (15) and the clearance compensation elements (33) is obtained. A bore (35), parallel to one of the smaller faces (36,37) of the cam follower (3), leads from the first clearance compensation element (33), which is adjacent to the bore (34), to the second clearance compensation element (33).

Various modifications of the device of the invention may be made without departing from the spirit or scope thereof and it is to be understood that the invention is intended to be limited only as defined in the appended claims.

What is claimed is:

1. A device (1) for simultaneous actuation of at least two gas exchange valves (2) of an internal combustion engine comprising a bridge-type cam follower (3) with a generally rectangular outer contour arranged in driving relationship between a camshaft and the gas exchange valves (2) and serving to directly transmit a stroke motion caused by a control cam (4) of the camshaft to the gas exchange valves (2), said cam follower (3) being guided by guiding means (18,19) for substantially uniform vertical displacement in a cylinder head and comprising a cam contacting element (31) on which the control cam (4) contacts, characterized in that the cam contacting element (31) formed on a lever (5) mounted in the cam follower (3) is displaceable relative to the cam follower (3) so that the cam follower (3) can be uncoupled from a stroke-transmitting motion of the control cam (4) for at least a portion of the stroke-transmitting motion of the control cam, the cam follower being guided at one of its smaller sides (36,37) by guiding columns (18,19) connected to the cylinder head, said columns (18,19) extending in complementary bores (38,39) of the cam follower (3) opposite the gas exchange valves (2) while being fixed optionally in the cylinder head or in the cam follower (3) to be slidable in the other one of the cam follower (3) and the cylinder head and a displaceable coupling means (15) is provided in the lever (5), the coupling means (15) comes to extend beyond at least one parting plane (30) formed between the lever (5) and the cam follower (3) to effect coupling, the cam contacting element (31) being brought to bear against the control cam (4) by the lever (5) and by a spring means (7) acting between the lever (5) and the cam follower (3).

2. A device of claim 1 wherein at least one of the cam follower (3) and the lever (5) is made of a light-weight and a polymeric material.

3. A device of claim 1 wherein the lever (5) is made as a rocker arm mounted near a transverse central plane thereof on the cam follower (3), the cam contacting element (31) being arranged on one end of the lever (5) and at least one coil spring acting as the spring means (7) being arranged on another end of the lever (5), with ends (8,9) of the coil spring (7) acting on an end face (10) of the lever (5) and on a corresponding end face (12) of the cam follower (3).

4. A device of claim 1 wherein a mounting for the lever (5) comprises a pin (6) which is arranged in a bore (13) of the lever (5) and whose ends extend into a complementary receiving bore (14) of the cam follower (3).

5. A device of claim 3 wherein a mounting for the lever (5) comprises a pin (6) which is arranged in a bore (13) of the lever (5) and whose ends extend into a complementary receiving bore (14) of the cam follower (3).

6. A device of claim 1 wherein the means for coupling the lever (5) comprises at least one pin (15) which is displaceable by a hydraulic medium and is arranged optionally in a bore (17) of the cam follower (3) or in a bore (16) of the lever (5), and both said bores (16,17) extend generally parallel to camshaft direction and are aligned with each other in a coupled state between the lever (5) and the cam follower (3) during a base circle phase of the control cam (4), a part of a longitudinal length of the pin (15) being displaceable into the other of said two bores (16 or 17) in each case.

7. A device of claim 1 wherein the cam contacting element (31) is made as a roller mounted on a rolling bearing extending only slightly beyond the cam follower (3) in a coupled state thereof.

8. A device of claim 3 wherein the cam contacting element (31) is made as a roller mounted on a rolling bearing extending only slightly beyond the cam follower (3) in a coupled state thereof.

9. A device of claim 1 wherein the cam follower (3) has a generally rectangular outer contour and is guided at one of its smaller sides (36,37) by guiding columns (18,19) connected to the cylinder head, said columns (18,19) extending in complementary bores (38,39) of the cam follower (3) opposite the gas exchange valves (2) while being fixed optionally in the cylinder head or in the cam follower (3) to be slidable in the other one of the cam follower (3) and the cylinder head.

10. A device of claim 1 wherein the cam follower (3) comprises clearance compensation elements (33) which cooperate with the gas exchange valves (2) and are arranged on a smaller side (37) of the cam follower (3) opposite the columns (18,19).

11. A device of claim 1 wherein the cam follower (3) comprises clearance compensation elements (33) which cooperate with the gas exchange valves (2) and are arranged on the smaller side (37) of the cam follower (3) opposite the columns (18,19).

12. A device of claim 1 wherein a supply of hydraulic medium from the cylinder head via the cam follower (3) to the coupling means (15) is assured by a duct (17*a*) extending through at least one of the columns (18,19).

13. A device of claim 10 wherein a supply of hydraulic medium from the cylinder head via the cam follower (3) to the clearance compensation elements (33) is assured by a duct (17*a*) extending through at least one of the columns (18,19).

14. A device of claim 13 wherein the cam follower (3) comprises a common duct for feeding hydraulic medium to the coupling means (15) and the clearance compensation elements (33).

15. A device of claim 13 wherein the cam follower (3) comprises a common duct for feeding hydraulic medium to the coupling means (15) and the clearance compensation elements (33).

16. A device of claim 14 wherein, in a region of the cam follower (3), there is arranged a bore (20) which intersects the column (18) orthogonally to its duct (17*a*) and from which a duct (21) extends close to a side wall (22) of the cam follower (3) and parallel thereto to open into the bore (17) of the coupling means (15) in the cam follower (3) and emerges therefrom in alignment with a further bore (34) which leads to a first clearance compensation element (33) and communicates with a further bore (35) extending at right angles thereto and leading to a further clearance compensation element (33).

17. A device of claim 6 wherein the coupling means (15) is biased in the coupling direction by the force of a pressure spring (25) supported at one end on a base (26) of the bore (16) of the lever (5) with its other end acting on an end face (24) of the pin (15), and wherein uncoupling is obtained by hydraulic medium pressure acting against the force of the pressure spring (25).

18. A device of claim 17 wherein a stop means (29) for limiting a coupling motion of the coupling means (15) is arranged, seen radially inwards, behind a hydraulic medium duct (21) in the bore (17) of the pin (15) in the cam follower (3).

19. A device of claim 1 wherein at least one of the cam follower (3) and the lever (5) is made of a light-weight or a polymeric material.

20. A device of claim 17 wherein a stopper (27) serves at the same time as a support for the pressure spring (25) on the base (26) of the bore (16) of the lever (5).

* * * * *